United States Patent [19]

Kellett

[11] Patent Number: 4,869,318

[45] Date of Patent: Sep. 26, 1989

[54] ANNULUS VALVE FOR CONCENTRIC TUBING HANGERS

[75] Inventor: Rodney Kellett, Morley, England

[73] Assignee: Cameron Iron Works USA, Inc., Houston, Tex.

[21] Appl. No.: 242,530

[22] Filed: Sep. 12, 1988

[30] Foreign Application Priority Data

Jul. 6, 1988 [EP] European Pat. Off. ..... 88306135.0

[51] Int. Cl.[4] ..... E21B 33/03

[52] U.S. Cl. ..... 166/87; 166/97; 166/321

[58] Field of Search ..... 166/373, 374, 375, 382, 166/386, 72, 86, 87, 97, 321, 325, 332; 251/321, 343, 344

[56] References Cited

U.S. PATENT DOCUMENTS

| | | | |
|---|---|---|---|
| 3,360,048 | 12/1967 | Watkins | 166/87 |
| 4,125,155 | 11/1978 | Block, Jr. | 166/87 X |
| 4,333,526 | 6/1982 | Watkins | 166/87 |
| 4,449,583 | 5/1984 | Lawson | 166/72 |

*Primary Examiner*—William P. Neuder

[57] ABSTRACT

An improved valve for controlling flow through a tubing hanger in a unit having a concentric tubing system and includes upwardly facing recesses or blind pockets in the hanger with a valve member in each of said pockets and having circumferential seals around its upper end and around its lower enlarged end, the valve members are biased upwardly in their pockets by springs and by annulus pressure which is transmitted to the lower end of the valve members through valve passages, the valve members each includes an upper projection or rod which is engaged by an annular actuator controlled responsive to a downwardly exerted spring force and by a pressure area differential which is exposed to annulus pressure and control pressure to urge the annular actuator downwardly which movement moves the valve member to its downward or open position. Control line pressure is provided to the actuator and to the exterior surface of the valve members below their upper seals so that the movement of the valve members can be controlled from remote locations.

7 Claims, 3 Drawing Sheets

ANNULUS VALVE FOR CONCENTRIC TUBING HANGERS

BACKGROUND

The present invention relates to an improved annulus valve for concentric tubing hangers. Valves have been known in the past to provide a means of closing the passage through a tubing hanger which provides communication of the annulus below the hanger with the annulus above the hanger. Such valves have included a check valve which is biased toward closed (upper) position by a spring and includes an integral rod extending upwardly above the hanger so that when the xmas tree mandrel is landed a plate thereon engages the upper end of the rod and causes the rod to move the valve member downwardly against spring force to thus unseat the valve and provide communication through the hanger passage. Such prior art valves have been deemed to be unsafe because on landing the tree the valve is opened before the tree connector can be locked to the wellhead housing and tested. This creates a potential hazard when there is gas under pressure in the annulus below the hanger. Additionally the valve cannot be closed and tested before pulling the tree. If the valve is going to fail to shut, this should be known in advance so that the annulus can be killed before pulling the tree.

Another type of valve known in the past is a valve which includes an inner sleeve for opening and closing flow through the hanger and the valve is spring-loaded, pressure-assist to close design, with parallel seals closing off a side outlet port from the annulus bore. The valve is maintained open by a constant pressure from the control circuitry in production mode. The valve can be tested for effective closure before pulling the tree but it requires extra umbilical/production control system cost and also the annulus communication is lost in the event of control line failure.

Still another type of shut-off mechanism includes an electrical connector. These types of systems require multiple additional control functions in the production mode which is economically disadvantageous in comparison to a dual-bore tubing hanger system.

U.S. Pat. No. 3,360,048 discloses a structure in which the flow through a hanger from its annulus is controlled by a sleeve valve operated by a wireline tool.

U.S. Pat. No. 4,449,583 discloses an annulus spring check valve and a pressure fluid by-pass. It is proposed that the check valve can be opened and communication established through the by-pass by a handling tool through a stabbing operation or by pressure on the check valve delivered via the production upper body.

SUMMARY

The present invention provides an improved valve for controlling flow through a tubing hanger in a unit having a concentric tubing system and includes upwardly facing recesses or blind pockets in the hanger with a valve member in each pocket and each valve member having circumferential seals around its upper end and around its lower enlarged end, the valve members are biased upwardly in their pockets by springs and by annulus pressure which is transmitted to the lower end of the valve members through passages in the valve members, the valve members each includes an upper rod which is engaged by an actuator, which is annular in shape and is controlled responsive to a downwardly exerted spring force and by a pressure area differential which is exposed to the difference between the annulus pressure and control line pressure to urge the actuator downwardly which movement moves the valve member to its downward or open position. Control line pressure is provided to the actuator and to the exterior surface of the valve members below their upper seals so that the movement of the valve members can be controlled from remote locations.

An object of the present invention is to provide an improved annulus valve for concentric tubing strings which does not present any safety hazard.

Another object is to provide an improved annulus valve for concentric tubing strings which may be closed at any time to check its operation particularly before pulling the tree.

A further object is to provide an improved annulus valve for concentric tubing strings which remains closed during landing, sealing and testing of the tree structure.

Still another object is to provide an improved annulus valve for concentric tubing strings which does not increase the cost of the umbilical/production control system.

A still further object is to provide an improved annulus valve for concentric tubing strings which does not lose annulus communication in the event of control line failure.

Still a further object is to provide an improved annulus valve for concentric tubing strings which may be used with either hydraulic or other controls.

A still further object is to provide an improved annulus valve for concentric tubing strings to control flow through an annulus flowpath in which the seals are not exposed to the flowpath.

BRIEF DESCRIPTION OF THE DRAWINGS

These and other objects and advantages of the present invention are hereinafter set forth and explained with reference to the drawings wherein.

DESCRIPTION OF THE PREFERRED EMBODIMENTS

Figure 1:
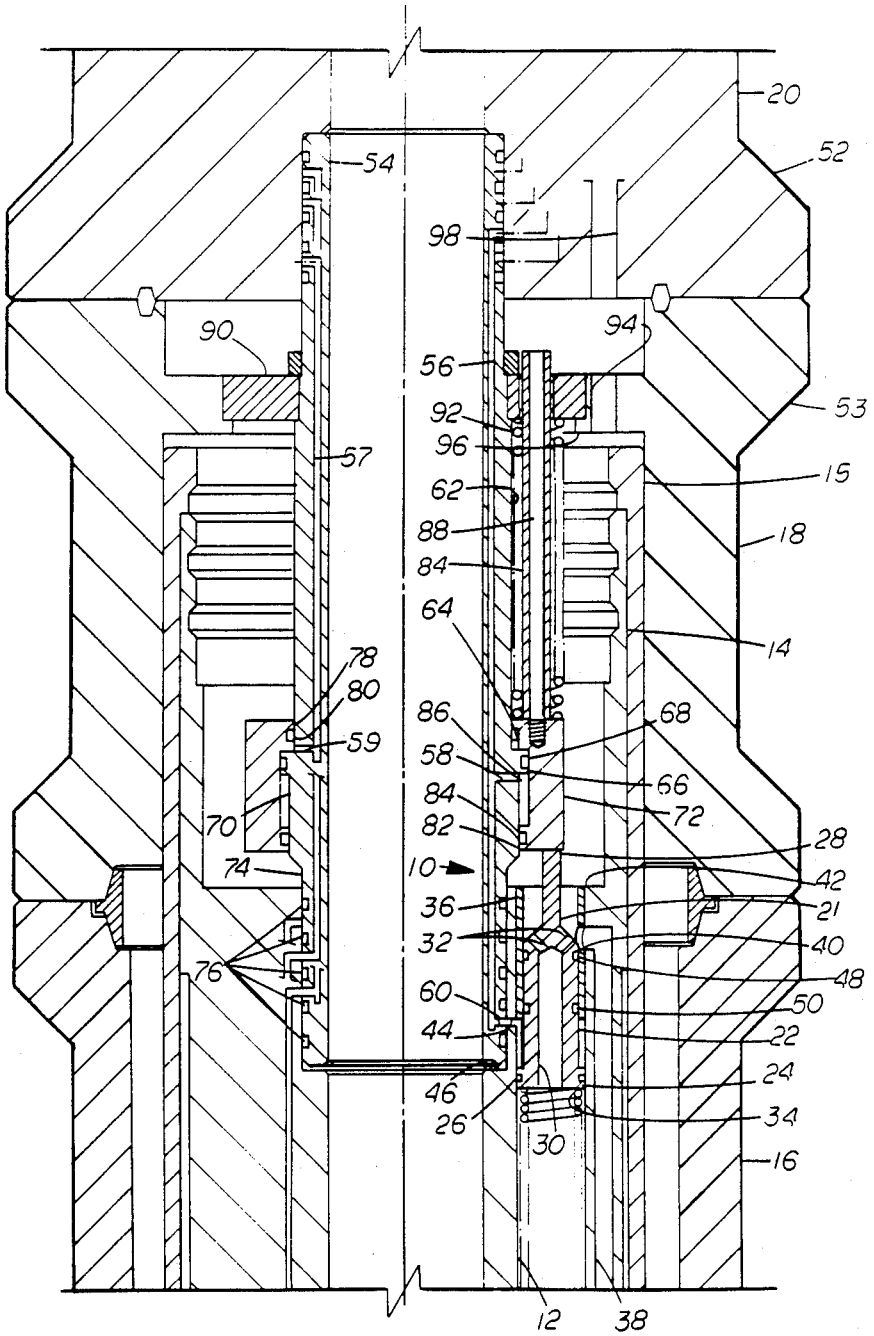
FIG. 1 is a schematic sectional view of the improved annulus valve in its production mode.
Figure 2:
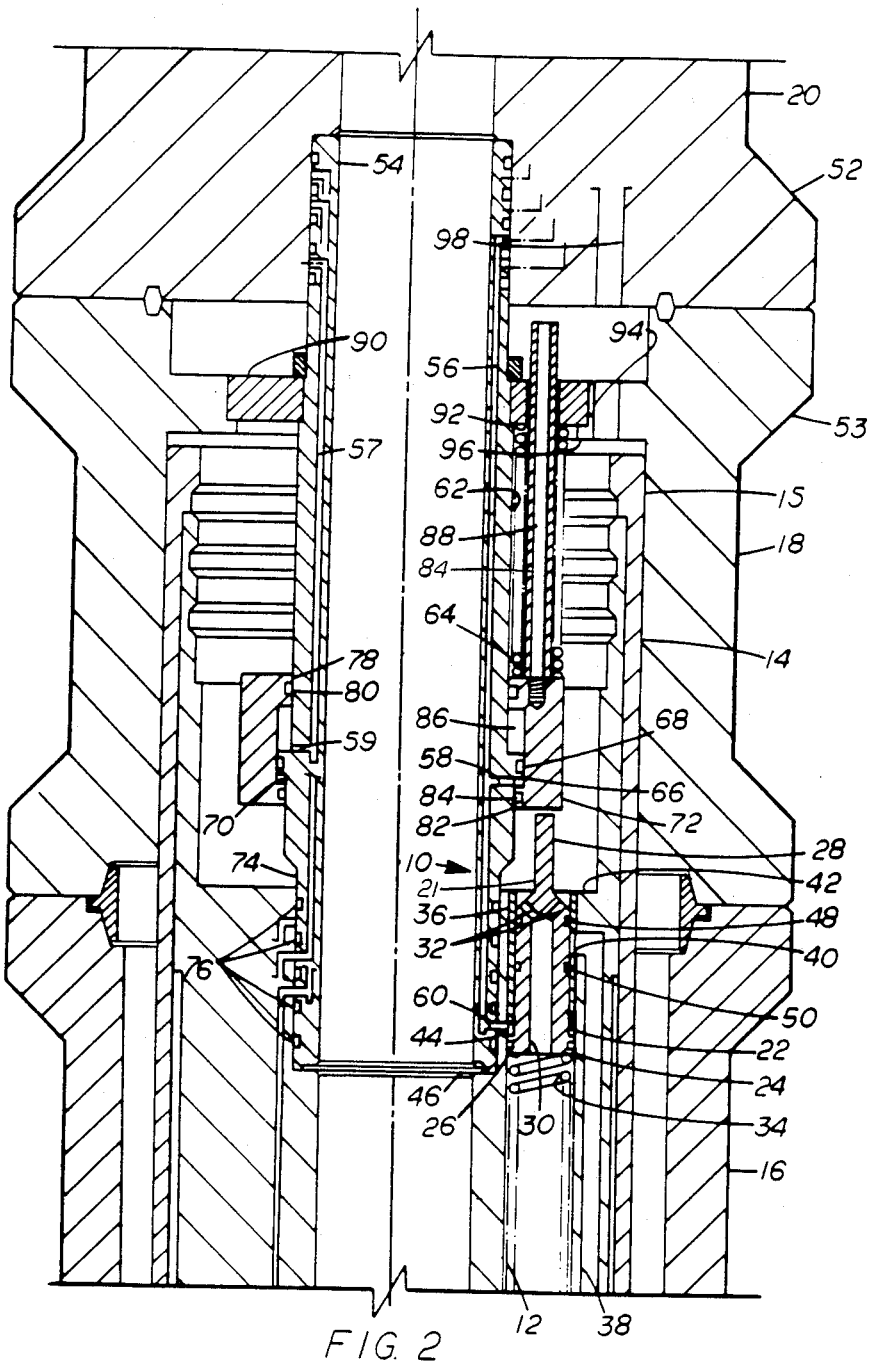
FIG. 2 is a similar schematic sectional view of the improved annulus valve with the valve member in closed position.
Figure 3:
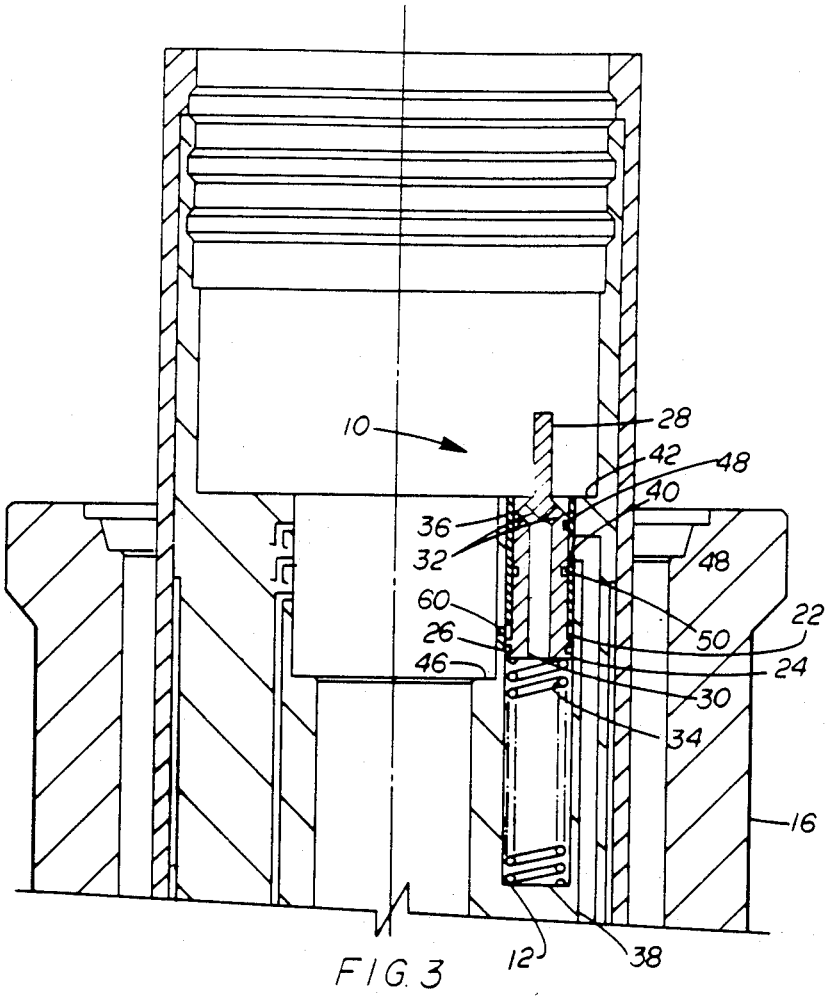
FIG. 3 is another similar schematic sectional view of the improved annulus valve illustrating the valve positioned in a temporary abandoned mode.

Improved annulus valve 10 is shown in FIGS. 1, 2, and 3 positioned within recess or blind pocket 12 which is formed in the upper surface of tubing hanger 14. Tubing hanger 14 is landed within wellhead housing 16 and has connector spool 18 connected thereto to connect between housing 16 and xmas tree 20. Sleeve 15 is positioned in the space between hanger 14 and housing 16 and functions to set the annular seal (not shown) between the exterior surface of hanger 14 and the interior surface of housing 16. Housing 16, spool 18 and tree 20 are all suitably connected by remotely operated clamping devices (not shown), such as collet clamps which are well known in the art.

Valve 10 includes valve member 21 having lower cylindrical body 22 with lower flange 24 which fits closely within recess 12 and includes suitable seal, such as O ring 26, for sealing against the interior of recess 12, and upper rod shaped projection 28 which is substantially smaller in diameter than body 22 and extends upwardly from the upper end of body 22. Bore 30 extends into body 22 from the lower end thereof and terminates a short distance below the upper end of body 22. Ports 32 communicate through body 22 immediately below projection 28 between the upper end of bore 30 and the exterior of body 22 which tapers into projection 28. Spring 34 is positioned within recess 12 and exerts an upward force on body 22. Sleeve 36 is secured and sealed within the upper portion of recess 12 to provide a lining thereof. Annulus passage 38 extends upwardly through tubing hanger 14 and then radially inward through port 40 in sleeve 36 into the interior of recess 12. Sleeve 36 extends from the upper surface 42 of tubing hanger 14 downwardly in recess 12 and terminates at a position below port 40 and slightly above port 44 which extends radially inward from the interior of recess 12 through to the interior of hanger 14 above internal upwardly facing shoulder 46 on hanger 14. Sealing means 48, which may be an 0 ring or other suitable sealing means, extends around the upper end of valve body 22 for sealing against the interior of sleeve 36 and sealing means 50, which may be an 0 ring or other suitable sealing means, is positioned around the exterior of body 22 between sealing means 48 and flange 24 for sealing against the interior of sleeve 36 near its lower end when valve member 21 is in its open or production mode as illustrated in FIG. 1. The position of sealing means 50 with valve member 21 in its lower position is against the interior of sleeve 36 at a position above port 44 in hanger 14.

Xmas tree 20 is landed with its flange 52 on flange 53 on the upper end of connector spool 18 and is secured and sealed thereto by suitable means (not shown). Mandrel 54 of xmas tree 20 is positioned within the interior thereof, extends downwardly into the interior of tubing hanger 14 and in its landed position has its lower end within hanger 14 and slightly above shoulder 46 on the interior of hanger 14. Mandrel 54 is provided with a plurality of control passages for conducting control pressure fluid into tubing hanger 14 as shown. Control passage 56 provides a communication from xmas tree 20 downwardly through mandrel 54 and radially outwardly through port 58 at a position above surface 42 of tubing hanger 14 and also to port 60 which registers with port 44 though hanger 14 into the interior of recess 12. Control passage 57 provides a communication from xmas tree 20 downwardly through mandrel 54 and radially outwardly through port 59 at a position above shoulder 64 on the exterior of mandrel 54. It should be understood that shallow grooves either in the interior of hanger 14 or in the exterior of mandrel 54 are contemplated to allow communication with ports 59, 58 and 56 they are not in exact registry with the ports in mandrel 54 to allow for rotary mis-orientation of mandrel 54 within hanger 14.

The exterior of mandrel 54 above upper surface 42 of hanger 14 includes cylindrical surface 62 which terminates in upwardly facing shoulder 64. Surface 66 below shoulder 64 has a larger diameter than surface 62 and includes sealing means, such as O ring 68. Surface 66 terminates a short distance below O ring 68 and reduced diameter outer surface 70 extends therebelow for a preselected distance to allow movement of annular piston 72 and then tapers into cylindrical surface 74 which includes a plurality of axially spaced sealing means 76. Sealing means 76 are positioned above and below the ports which extend outwardly from the exterior of mandrel 54 for communication with ports in hanger 14 for conducting control fluid downwardly therein as shown. Annular piston 72 includes upper inwardly extending annular flange 78 with O ring 80 positioned on the inner surface of flange 78 to seal against surface 62 of mandrel 54 above shoulder 64. Lower flange 82 extends inwardly from the lower portion of piston 72 and includes O ring 84 for sealing against surface 70. It should be noted that port 58 communicates with chamber 86 between surface 70 and the interior of piston 72 and between O rings 80 and 84. Guide rods 88 extend through tubes 89 and are secured into the upper surface of piston 72 and extend upwardly through openings in ring 90 which is secured on the exterior of mandrel 54 as shown. Springs 92 surround tubes 89 between the lower surface of ring 90 and the upper surface of piston 72. Springs 92 thus bias piston downwardly. Projection 28 of valve member 21 engages the lower surface of annular piston 72, as shown, to control the position of valve member 21. Opening 94 through inner flange 96 on spool 18 which supports ring 90 and passage 98 in xmas tree 20 provide a continuation of communication of annulus passage 38 when valve member 21 is in its open position.

In operation, tubing is run through the riser, blowout preventer and tree with piston 72 in its pressurized down position, i.e., with pressure to port 58 and with port 59 vented. This position of piston 72 maintains valve member 21 in its lower position as shown in FIG. 1. When it is desired to close the annulus valve member 21, port 58 is vented and pressure is supplied through port 59. This position is shown in FIG. 2 and closes valve member 21 so that valve 10 may be pressure tested at any time to insure proper closure before taking further action. With annulus valve 10 closed and a wireline plug positioned within the interior of hanger 14, tree 20 and spool connector 18 may be removed. This position is illustrated in FIG. 3. Any change of pressure Within the annulus passage 38 below valve 10 will not change the position of valve member 21. It is held in position by spring 34 and any pressure above valve member 21 is conducted through bore 30 into the lower portion of recess 12 so that there are no unbalanced pressure forces on valve member 21.

It is contemplated that even though only one of the annulus valves has been shown, there may be a plurality of the annulus valves, such as for example, three annulus valves 10 spaced uniformly around hanger 14 to provide the desired flow area through hanger 14. By utilizing an annular actuator 72, its lower surface will engage the projections 28 of each of the valve members 21 so that their operations will be uniform and assure that they will all open at the same time.

With the improved structure of the present invention, anytime the tree 20 is removed the annulus valve is closed and further it can be closed anytime by operation of piston 72 into its upper position. While piston 72 is a pressure responsive actuator any other suitable type of actuator which can be controlled from the surface is contemplated herein. It is intended that any of such actuators include an annular ring such as piston 72 which either engages projection 28 or when in its upper position disengages from projection 28 as shown in FIGS. 2 and 3. By operation of piston 72 or other suitable actuator, valve member 21 may be closed at any time to check its operation or to prepare for other operations. By preloading piston 72 into its upper position during landing of tree 20, valve member 21 is ensured of being in the closed position until it is positively opened by piston 72. A particular advantage of the present invention is that failure of control pressure does not result in the loss of annulus communication because of the spring biasing of piston 72 toward valve member 21 biases valve member 21 toward its open position.

What is claimed is:

1. An annulus valve to control annulus flow through concentric tubing hanger comprising:

a wellhead housing having an inner wall, a tubing hanger positioned within said housing and being spaced from said inner housing wall, said tubing hanger having an upper surface and a recess extending downwardly therefrom and terminating in an upwardly facing surface, a lower annulus between the tubing hanger and the inner wall below said upwardly facing recess surface, an upper annulus between the tubing hanger and the inner wall above said upwardly facing recess surface, said tubing hanger having a passage therethrough to communicate between said lower annulus and said upper annulus and terminating in said recess, a valve member positioned within said recess, means biasing said valve member toward its position closing flow from said passage into said recess, means biasing said valve member toward its position closing flow from said passage into said recess, a tree connected above said housing and having a downwardly extending mandrel, and an actuator carried by said mandrel, means for moving the actuator axially of said mandrel, means providing interengagement between said actuator and said valve member whereby movement of said actuator in one direction moves said valve member to its open position and movement of said actuator in the opposite direction allows said valve member to return to its closed position.

2. An annulus valve according to claim 1 wherein said actuator is a pressure responsive actuator, and said tree mandrel includes passages for the delivery of pressure fluid to said pressure responsive actuator.

3. An annulus valve according to claim 1 wherein said actuator is a pressure responsive actuator, and including means for supplying fluid under pressure to said actuator through said tree.

4. An annulus valve according to claim 1 including means communicating through said valve member into the lower portion of said recess below said valve member, said valve member having a flange extending outwardly on its lower end in said recess to seal against the interior of said recess, annulus pressure delivered through said valve member to said recess biasing said valve member toward closed position.

5. An annulus valve according to claim 1 wherein said actuator is biased in the direction to maintain said valve member in its open position.

6. An annulus valve according to claim 1 wherein said interengagement means includes a projection extending upwardly from the upper end of said valve member and having an upper end in engagement with said actuator.

7. An annulus valve according to claim 1 including a sleeve positioned in the upper end of said recess surrounding said valve member and having a port registering with tubing hanger passage terminating in said recess, means carried by said valve member for sealing against said sleeve above said port when said valve member is in its closed position.

* * * * *